United States Patent [19]

Bowen et al.

[11] Patent Number: 4,828,252

[45] Date of Patent: May 9, 1989

[54] TRAINING APPARATUS FOR ATHLETES

[76] Inventors: James E. Bowen, 6605 Hamilton-Middletown Rd., Middletown, Ohio 45044; Thomas D. Williams, 6314 Cotton Run Rd., Middletown, Ohio 45042

[21] Appl. No.: 864,456

[22] Filed: May 19, 1986

[51] Int. Cl.[4] ..... A63B 21/00

[52] U.S. Cl. ..... 272/117; 272/123; 273/55 R

[58] Field of Search ..... 272/117, 118, 120, 123, 272/125–128, 134, DIG. 4; 273/55 R, 191, 191 A, 191 B; 193/38

[56] References Cited

U.S. PATENT DOCUMENTS

| | | | |
|---|---|---|---|
| 3,235,053 | 2/1966 | Wood | 193/38 |
| 3,235,255 | 2/1966 | Leflar | 272/123 |
| 3,703,294 | 11/1972 | Fitch | 273/191 B |
| 3,866,914 | 2/1975 | Jackson | 273/55 R |
| 4,140,315 | 2/1979 | Page, Jr. | 273/55 R |
| 4,176,836 | 12/1979 | Coyle | 272/120 |
| 4,354,675 | 10/1982 | Barclay et al. | 272/134 X |
| 4,632,392 | 12/1986 | Peyton et al. | 272/128 |
| 4,720,103 | 1/1988 | Palladino, Jr. | 273/55 R |

OTHER PUBLICATIONS

"Muscle Humor", In Strength and Health Publishing Co., p. 54, Received in PTO 5/1964, Copy in 272/123.

*Primary Examiner*—Richard J. Apley
*Assistant Examiner*—Robert D. Bahr
*Attorney, Agent, or Firm*—D. F. Marquette; J. C. McGowan

[57] ABSTRACT

Apparatus for training athletes, especially football lineman, includes a frame having a pair of guide rails extending between front and rear upright posts. The guide rails are arranged parallel to each other and have generally horizontal sections and inclined sections. The training apparatus also includes a weight assembly supported by the frame for movement on the guide rails. In using the training apparatus, an athlete moves upwardly and forwardly from a crouched position between the front upright posts of the frame and pushes the weight assembly along the horizontal sections of the guide rails and then up the inclined sections of the guide rails. The training apparatus is particularly effective in developing and strengthening the upper body muscles of athletes.

8 Claims, 2 Drawing Sheets

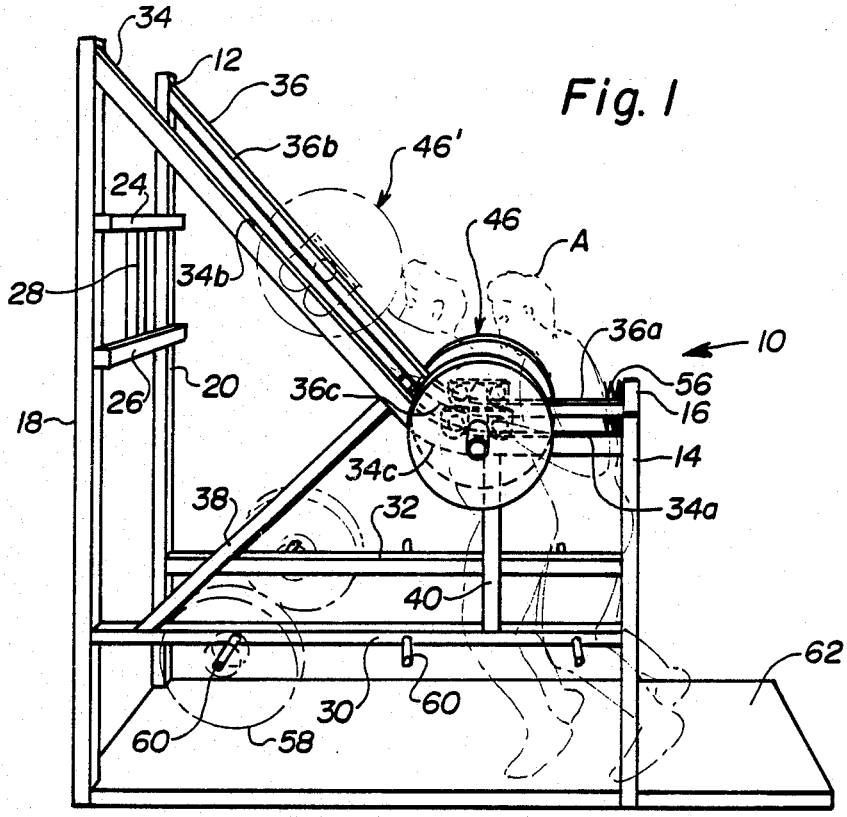
Fig. 1
Fig. 2
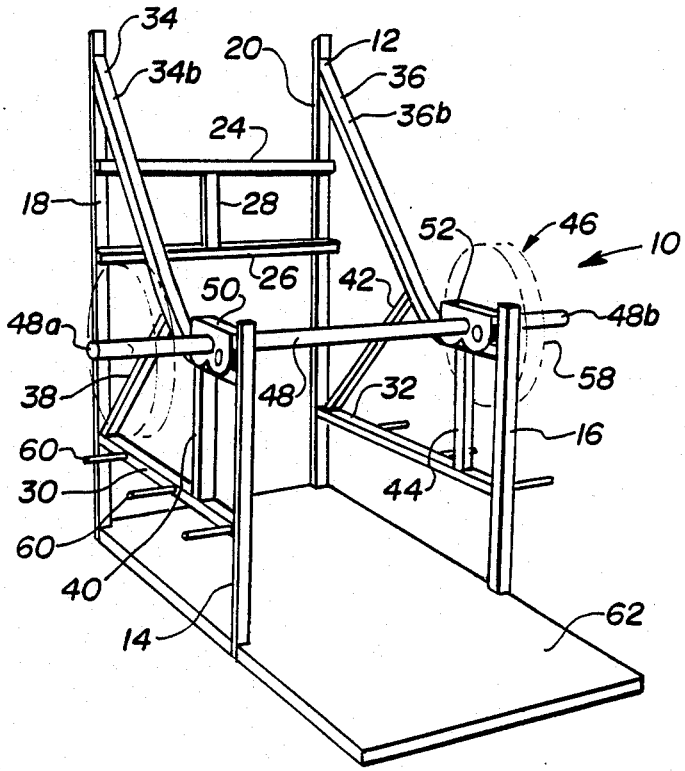

TRAINING APPARATUS FOR ATHLETES

BACKGROUND OF THE INVENTION

This invention relates to exercise equipment and, in particular, to training apparatus for athletes such as football players.

In the game of football, linemen are trained to move from a three point stance with a quick explosive thrust to drive opponents off the line of scrimmage. Conventional exercise equipment, such as blocking sleds and weight lifting apparatus which have been used in the past to train football players, develop pure strength but are not totally satisfactory in training football linemen to make the explosive movement they need to be effective. This is because conventional exercise equipment develops slow twitch muscle fiber while fast twitch muscle fiber remain undeveloped. It is known, however, that if fast twitch muscle fiber is also developed and strengthened, the explosive movement of football linemen will improve.

U.S. Pat. No. 3,866,914 discloses a device for training athletes. The disclosed device consists of a frame having a pair of inclined guides on which several weight members are slidably mounted. In using this device, an athlete such as a football lineman assumes a crouching position and then pushes the weight members up the inclined guides with his shoulders. While this device is effective in teaching the proper movement for football linemen, it primarily strengthens the back and leg muscles without developing the upper body muscles in the arms, neck and shoulders.

SUMMARY OF THE INVENTION

It is an object of the present invention to increase the power, speed and strength of athletes.

It is another object of the present invention to provide training apparatus for athletes that develops fast twitch muscle fiber by requiring movement based on speed, explosion and power.

It is a further object of the present invention to provide training apparatus for athletes which develops and strengthens upper body muscles in the arms, neck and shoulders.

It is also an object of the present invention to provide training apparatus for athletes which teaches the proper movement for football linemen.

The present invention accomplishes these objects by providing apparatus for training athletes having a frame including a pair of guide rails arranged substantially parallel to each other. The guide rails each have a generally horizontal section and an inclined section. A weight assembly is supported by the frame for movement on the guide rails. The weight assembly is movable along the horizontal sections of the guide rails and then up the inclined sections of the guide rails when pushed by an athlete thereby developing and strengthening the upper body muscles of the athlete.

In the preferred embodiment of the training apparatus, the weight assembly includes a bar extending transversely of the frame and adapted to be grasped by an athlete with his hands. The weight assembly also includes disks of any desired number and weight supported on the opposite end portions of the bar. The weight assembly further includes housings mounted on the bar and enclosing rollers which ride on the guide rails.

DESCRIPTION OF THE DRAWINGS

FIG. 1 is a side perspective view of training apparatus according to the present invention.

FIG. 2 is a front perspective view of the training apparatus of the present invention;

DESCRIPTION OF THE INVENTION

Figure 3:
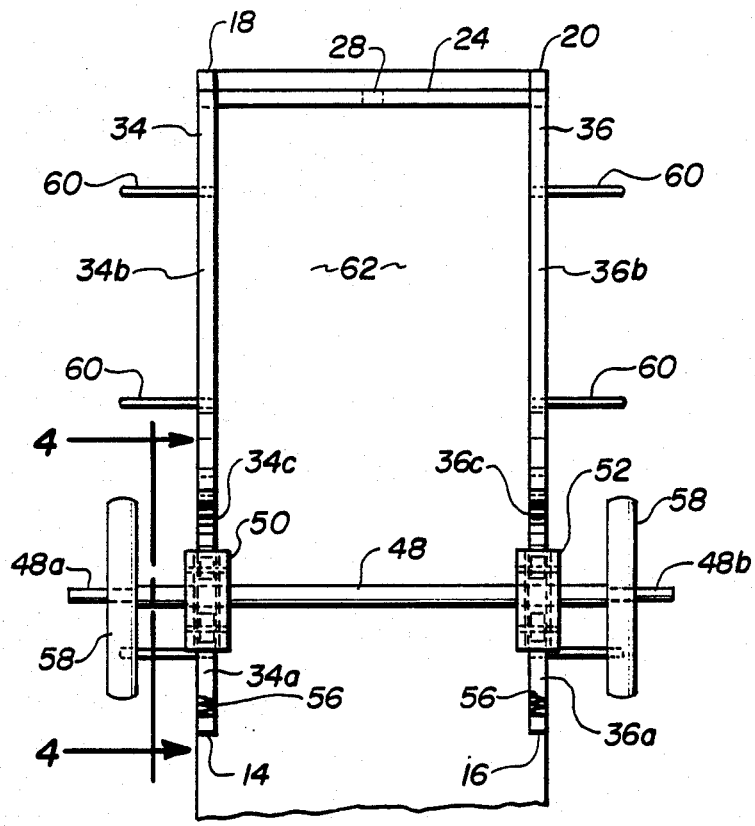
FIG. 3 is a top plan view of the training apparatus of the present invention.

Referring to FIGS. 1 and 2, training apparatus 10 according to the preferred embodiment of the present invention includes a frame 12 preferably formed of a suitable metal such as steel and consisting of front upright posts 14, 16 and rear upright posts 18, 20. Rear cross braces 24, 26 are connected between the rear upright posts 18 and 20, and a further cross brace 28 is connected between the rear cross braces 24, 26. A side brace 30 is connected between the front upright post 14 and the rear upright post 18. Another side brace 32 is connected between the front upright post 16 and the rear upright post 20.

The frame 12 also includes guide rails 34, 36 extending between the front upright posts 14, 16 and the rear upright posts and the side brace 30. Braces 42 and 44 are connected between the guide rail 36 and the side brace 32. Guide rails 34, 36 are arranged parallel to each other and include generally horizontal sections **34*a*, 36*a*, inclined section 34*b*, 36*b*, and arcuate sections 34*c*, 36*c* between the horizontal sections 34*a*, 36*a* and the inclined sections 34*b*, 36*b***.

Figure 4:
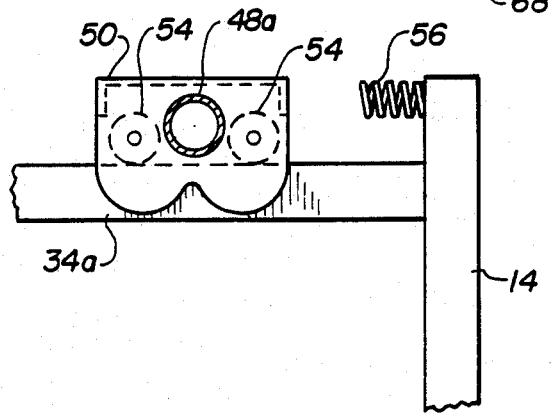
FIG. 4 is an enlarged sectional view taken along lines 4—4 in FIG. 3.

Training apparatus 10 also comprises a weight assembly 46 supported by the frame 12 for movement along the guide rails 34, 36. Weight assembly 46 includes a bar 48 extending transversely of the frame 12 with housings 50, 52 mounted thereon adjacent the opposite end portions **48*a*, 48*b* of the bar 48. The housings 50, 52 each support and enclose a pair of rollers designated 54 in FIG. 4 and preferably formed of rubber. These rollers 54 are arranged to contact and ride on the upper surfaces of the guide rails 34, 36. Springs 56 are mounted on the front upright posts 14, 16 for engagement with the housings 50, 52**.

Weight assembly 46 also consists of conventional barbell type disks 58 of any desired number and weight which are supported on the end portions **48*a*, 48*b* of the bar 48. Pegs 60 extend from side braces 30, 32 for storing additional disks 58. A mat 62 is provided at the bottom of the frame 12**.

The weight assembly 46 is positioned for use on the horizontal sections **34*a*, 36*a* of the guide rails 34, 36 adjacent the front upright posts 14, 16. An athlete (designated A in FIG. 1) positions himself on the mat 62 between the front posts 14, 16 and assumes a crouched position such as the common three point stance used in football. The athlete A then moves upward and forward from his crouched position with a quick explosive thrust grasping the bar 48 with both of his hands. The athlete pushes the weight assembly 46 along the horizontal sections 34*a*, 36*a* and the arcuate sections 34*c*, 36*c* of the guide rails 34, 36 and then substantially upwardly along the inclined sections 34*b*, 36*b* of the guide rails 34, 36 as indicated in phantom at 46'** in FIG. 1.

Figure 5:
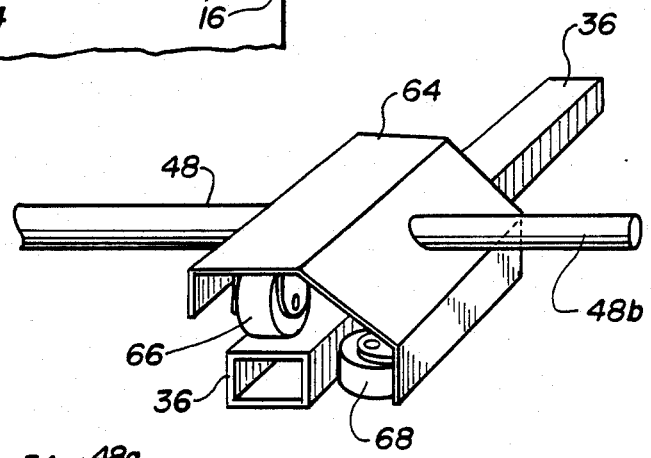
FIG. 5 is an enlarged perspective view illustrating a preferred form of part of the training apparatus.

A preferred form of housing 64 is shown in FIG. 5 for replacing the housings 50 and 52. Each housing 64 supports and encloses one pair of rollers 66 arranged to contact the upper surfaces of the guide rails 34, 36 and another pair of rollers 68 arranged to contact the outer side surfaces of the guide rails 34, 36. Thus, a total of eight rollers will be employed when using the housings 64 instead of four rollers when the housings 50, 52 are used. This arrangement of eight rollers provides smoother movement of the weight assembly 46 along the guide rails 34, 36 than the arrangement of four rollers, especially when an athlete exerts more force on the bar 48 with one hand than with the other hand.

It should be understood that the horizontal sections 34*a*, 36*a* of the guide rails 34, 36 constitute an important feature of the training apparatus 10 because they allow an athlete to start the weight assembly 46 moving before pushing it up the inclined sections of the guide rails 34, 36. The device disclosed in U.S. Pat. No. 3,866,914 does not have this feature and, therefore, the weight members must be pushed up the inclined guides from a dead start.

It will be understood that the distance an athlete is able to push the weight assembly 46 up guide rails 34, 36 is dependent upon his speed and strength. Since the training apparatus 10 emphasizes movement based on speed, athletes develop fast twitch muscle fiber. The training apparatus 10 also develops and strengthens the upper body muscles in the arms, neck and shoulders because these muscles are used in pushing the weight assembly 46 up the guide rails 34, 36.

Although the training apparatus of the present invention is intended primarily for teaching football linemen the proper movement for their position, it may also be used to help basketball players increase vertical jumping ability and to help track and field athletes develop leg drive.

The following claims cover all modifications and variations of the preferred embodiment of the present invention disclosed herein.

What is claimed is:

1. An apparatus for training an athlete, particularly a football lineman, said apparatus comprising:

a frame including a pair of guide rails arranged substantially parallel to each other extending between a pair of front upright posts and a pair of rear upright posts, said guide rails each having a generally straight horizontal section connected to one of said pair of front upright posts, an inclined section connected to one of said pair of rear upright posts, and an arcuate section between said horizontal and inclined sections;

a weight assembly supported transversely of said frame on both of said pair of guide rails for movement on said guide rails, said weight assembly being movable forwardly along said generally straight horizontal sections and said arcuate sections of said guide rails and then substantially upwardly along said inclined sections of said guide rails when said weight assembly is pushed along said guide rails by an athlete positioned between said pair of guide rails, said generally straight horizontal sections allowing the athlete to push the weight assembly along the horizontal sections with minimal resistance before pushing the weight assembly up the arcuate and inclined sections thus simultaneously developing and strengthening the upper body muscles and the leg muscles of the athlete; and said weight assembly including a bar extending transversely of said frame and adapted to be grasped by the athlete with his hands.

2. The training apparatus of claim 1, wherein said weight assembly also comprises disks of any desired number and weight supported on the opposite end portions of said bar.

3. The training apparatus of claim 2, wherein said weight assembly further comprises a pair of housings mounted on said bar, and each of said housings supporting and enclosing rollers arranged to contact one of said guide rails.

4. The training apparatus of claim 3, wherein said frame also includes side braces connected between said front and rear upright posts, and further braces connected between said generally horizontal sections and said inclined sections of said guide rails and said side braces.

5. The training apparatus of claim 4, further comprising springs mounted on said front upright posts for engagement with said housings.

6. The training apparatus of claim 3, wherein each of said housings supports and encloses a pair of rollers arranged to contact the upper surface of one of said guide rails.

7. The training apparatus of claim 3, wherein each of said housings supports and encloses one pair of rollers arranged to contact the upper surface of one of said guide rails and another pair of rollers arranged to contact the outer side surface of one of said guide rails.

8. The training apparatus of claim 1, wherein said inclined sections of said guide rails are generally straight.

* * * * *